US005794261A

United States Patent [19]

Hefling

[11] Patent Number: 5,794,261

[45] Date of Patent: Aug. 18, 1998

[54] PROTECTIVE JOINT GUARD

[75] Inventor: Dennis V. Hefling, Ballwin, Mo.

[73] Assignee: Rawlings Sporting Goods Company, Inc., Fenton, Mo.

[21] Appl. No.: 816,189

[22] Filed: Mar. 12, 1997

[51] Int. Cl.[6] ..... A41D 13/06

[52] U.S. Cl. ..... 2/16; 2/24; 2/455

[58] Field of Search ..... 2/22, 24, 16, 2.5, 2/455, 456, 463, 467

[56] References Cited

U.S. PATENT DOCUMENTS

| | | | |
|---|---|---|---|
| 321,529 | 7/1885 | Rate | 2/16 X |
| D. 361,869 | 8/1995 | Paffett et al. | |
| 1,136,307 | 4/1915 | Bourdon . | |
| 1,777,088 | 9/1930 | Horath . | |
| 2,373,129 | 4/1945 | Magnus . | |
| 2,407,312 | 9/1946 | Magnus . | |
| 2,416,451 | 2/1947 | Magnus . | |
| 2,717,387 | 9/1955 | McMahan . | |
| 2,733,443 | 2/1956 | Holder . | |
| 2,982,968 | 5/1961 | Groot . | |
| 3,135,964 | 6/1964 | Fender . | |
| 3,465,364 | 9/1969 | Edelson . | |
| 3,533,106 | 10/1970 | Kremp . | |
| 3,703,171 | 11/1972 | Schlavitto . | |
| 3,867,239 | 2/1975 | Alesi et al. | 2/2.5 X |
| 3,898,697 | 8/1975 | Whitehead . | |
| 4,066,074 | 1/1978 | Keller . | |
| 4,144,592 | 3/1979 | Larson . | |
| 4,354,280 | 10/1982 | Hayes . | |
| 4,409,689 | 10/1983 | Buring . | |
| 4,484,360 | 11/1984 | Leighton . | |
| 4,494,534 | 1/1985 | Hutson . | |
| 4,497,070 | 2/1985 | Cho . | |
| 4,507,804 | 4/1985 | Consigny | 2/21 |
| 4,608,718 | 9/1986 | Reed . | |
| 4,627,108 | 12/1986 | Jarvinen . | |
| 4,633,529 | 1/1987 | Litz . | |
| 4,665,562 | 5/1987 | Winer . | |
| 4,669,126 | 9/1986 | Jones . | |
| 4,674,157 | 1/1987 | Litz . | |
| 4,692,946 | 9/1987 | Jurga . | |
| 4,700,406 | 10/1987 | Meistrell . | |

(List continued on next page.)

FOREIGN PATENT DOCUMENTS

| | | | |
|---|---|---|---|
| 16488 | 2/1934 | Australia . | |
| 949256 | 6/1974 | Canada . | |
| 2084329 | 3/1994 | Canada | 2/22 |
| 490913 | 5/1919 | France | 2/2.5 |
| 1935 278 | 1/1971 | Netherlands . | |
| 2 310 149 | 9/1974 | Netherlands . | |
| 23 62 044 | 6/1975 | Netherlands . | |
| 26 07 628 | 9/1977 | Netherlands . | |
| 26 58 050 | 6/1978 | Netherlands . | |
| 28 47 866 | 5/1980 | Netherlands . | |
| 1437 598 | 5/1976 | United Kingdom . | |
| 1556 357 | 11/1979 | United Kingdom . | |
| 1 561 252 | 2/1980 | United Kingdom . | |
| 2263621 | 8/1993 | United Kingdom | 2/16 |
| WO 92/13250 | 8/1992 | WIPO | 2/2.5 |

*Primary Examiner*—Michael A. Neas
*Attorney, Agent, or Firm*—Stinson, Mag & Fizzell

[57] ABSTRACT

A protective joint guard for use in contact sports particularly adapted for providing maximum protection and mobility over jointed body parts. The protective guard comprises a multiplicity of identical graduated interlocking rigid segments connected directly to one another by a pivot fastener and stop pin connection. The protective joint guard can be used as the joint portion of protective wear such as a leg guard by simply connecting a thigh guard and shin guard to opposing ends of the multiplicity of segments, in which case the protective joint guard is used to protect the knee from impact. The thigh guard, shin guard and joint guard are all made of a rigid material each having interior and exterior shells. To provide protection against contact with the interior shell, and to provided added cushion and comfort for the wearer, a first pad is detachably affixed to the interior shell of the thigh guard, said first pad extends the entire length of the joint guard. Although the first pad is affixed to the thigh guard, the first pad is able to move independent from the protective guard so that the linear length of the interlocking segments can easily increase and decrease without interference from the first pad.

18 Claims, 7 Drawing Sheets

U.S. PATENT DOCUMENTS 4,715,067 12/1987 Beauregard .
4,751,748 6/1988 Ekins .
4,868,926 9/1989 Lowson .
4,884,561 12/1989 Letson, Sr. .
4,888,826 12/1989 Parson, Jr. et al. .
4,905,681 3/1990 Glascock ..... 2/22 X
4,967,493 11/1990 Mues .
4,999,847 3/1991 Barcelo .
5,031,607 7/1991 Peters .
5,044,360 9/1991 Janke .
5,056,158 10/1991 Lutz .
5,135,473 8/1992 Epler .
5,140,995 8/1992 Uhl ..... 2/467 X
5,222,256 6/1993 Wang ..... 2/24
5,301,370 4/1994 Henson .
5,452,475 9/1995 Hunt, Jr. .
5,507,720 4/1996 Lampropoulos .
5,634,211 6/1997 Chen ..... 2/22

PROTECTIVE JOINT GUARD

FIELD OF THE INVENTION

The present invention relates to protective gear for use in contact sports and, more particularly, to protective gear designed to protect the legs, arms, shoulders or other jointed body parts while providing maximum range of motion and protection of such parts without impeding the mobility of a player.

BACKGROUND OF THE INVENTION

Many sporting activities require the need to protect the legs, arms, shoulders, feet and torso from fixed, moving or flying objects. It has been a constant challenge to adequately and fully protect these parts of a player's body in a manner that does not hinder the player's movement.

For example, baseball catchers require protective gear across their feet, shins, knees and upper thighs to protect their legs from the impact of flying balls or swinging bats. Full and adequate coverage of the legs is required while the catcher is in both a crouched and standing posture, as well as all postures in between. Because the linear length required to provide such protection increases when the knee is bent and decreases when the knee is straight, it is difficult to design protective leg gear that responds to the change in length, provides continued protection, provides comfort, mobility and full range of motion, and can extend almost the entire length of the wearer's leg.

Currently, there are no protective guards on the market that provide continuous protection spanning the length of the joint that are made entirely of a hard plastic shell and do not impede the wear's mobility and range of motion. While most guards provide continued protection across the joint, the protection is not comprised entirely of a hard plastic rigid shell. Generally, the protective joint guard comprises several hard rigid pieces that gap when the joint is bent, exposing the soft padding attached underneath and between the pieces. While this padding provides some protection against impact, it does not compare to the protection afforded the joint by a guard made entirely of solid hard plastic.

SUMMARY OF THE INVENTION

Accordingly, the general object of the present invention is to provide a protective guard with continued solid plastic protection spanning the entire length of the joint without regard to whether the joint is straight or bent. Further objects of the invention are to provide a guard (1) that is lightweight; (2) that allows a player maximum mobility and increased range of motion; and (3) that is comprised of a multiplicity of continuous solid plastic pieces that do not gap with the joint is bent.

In keeping with these objects, the main feature of the invention resides in a protective joint guard for use in contact sports particularly adapted for providing maximum protection and mobility over jointed body parts. The protective guard comprises a multiplicity of identical graduated interlocking rigid segments connected directly to one another by a pivot fastener and stop pin connection. The protective joint guard can be used as the joint portion of protective wear such as a leg guard by simply connecting a thigh guard and shin guard to opposing ends of the multiplicity of segments, in which case the protective joint guard is used to protect the knee from impact. The thigh guard, shin guard and joint guard are all made of a rigid material each having interior and exterior shells. To provide protection against contact with the interior shell, and to provided added cushion and comfort for the wearer, a first pad is detachably affixed to the interior shell of the thigh guard, said first pad extends the entire length of the joint guard. Although the first pad is affixed to the thigh guard, the first pad is able to move independent from the protective guard so that the linear length of the interlocking segments can easily increase and decrease without interference from the first pad.

The novel features which are considered as characteristic for the invention are set forth in particular in the appended claims. The invention itself, however, both as to its construction and its method of operation, together with additional objects and advantages thereof, will be best understood from the following description of the preferred embodiment when read in connection with the accompanying drawings.

DETAILED DESCRIPTION OF PREFERRED EMBODIMENT

As required, detailed embodiments of the present invention are disclosed herein; however, it is to be understood that the disclosed embodiments are merely exemplary of the invention, which may be embodied in various forms. Therefore, specific details disclosed herein are not to be interpreted as limiting, but rather merely as a basis for the claims and as a representative basis for teaching one skilled in the art to variously employ the present invention in virtually any appropriate manner.

Figure 1:
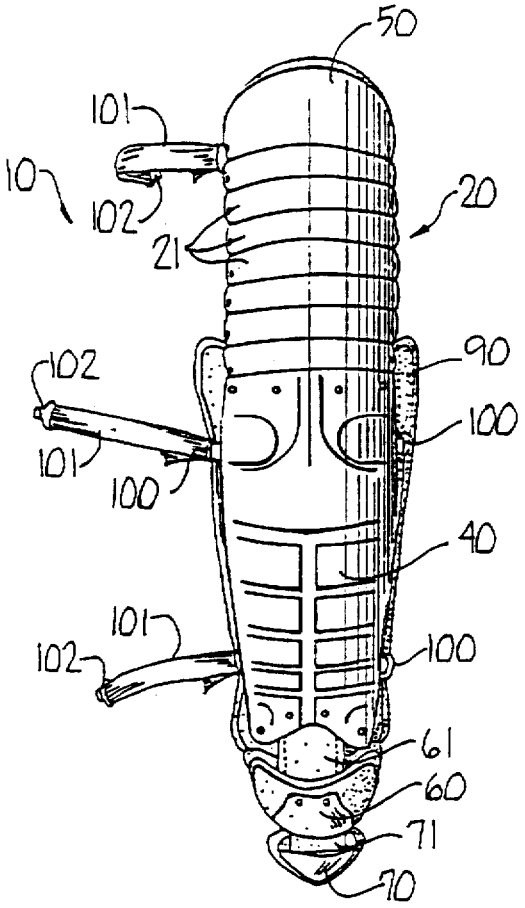
FIG. 1 is a front elevational view of the present invention adapted for use as a protective leg guard.
Figure 2:
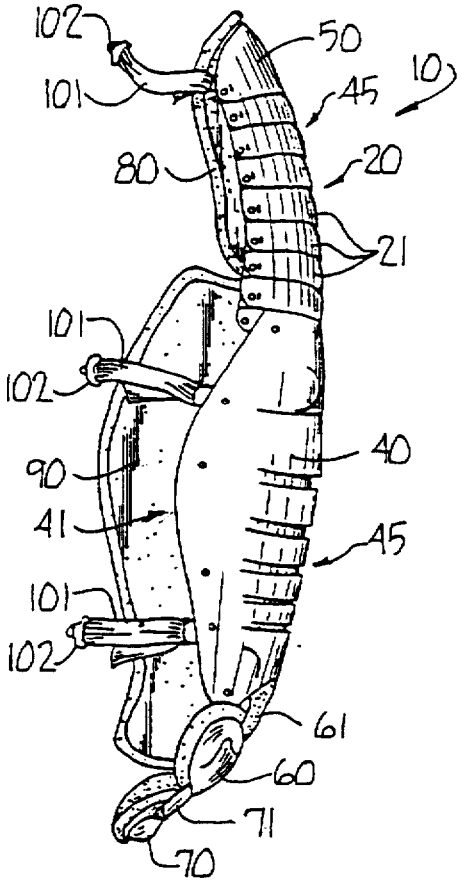
FIG. 2 is a side elevational view of the protective leg guard, as shown in FIG. 1.
Figure 3:
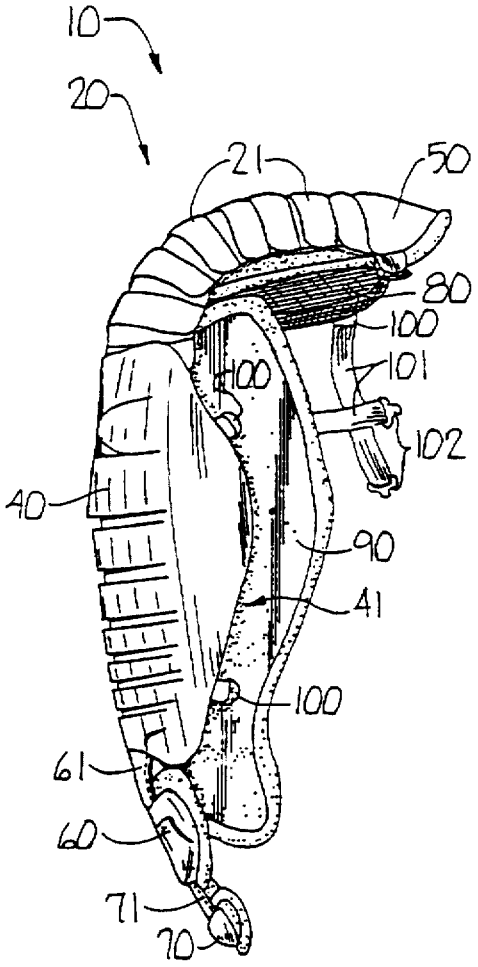
FIG. 3 is a side elevational view of the present invention adapted for use as a protective leg guard positioned with the knee portion of the leg guard bent.
Figure 4:
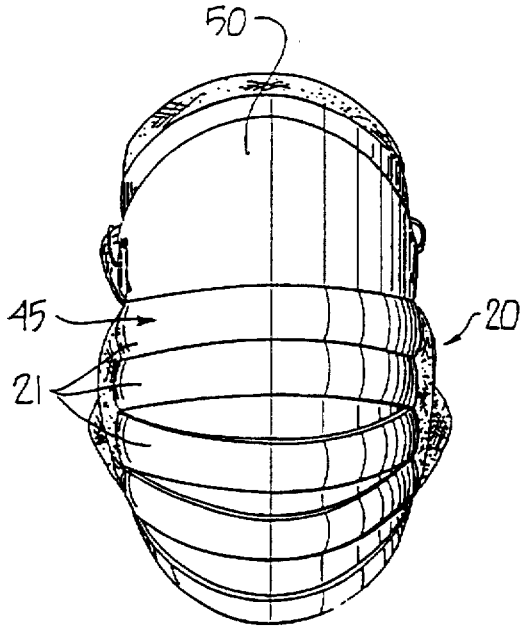
FIG. 4 is a plan view of the protective leg guard, as shown in FIG. 3.
Figure 9:
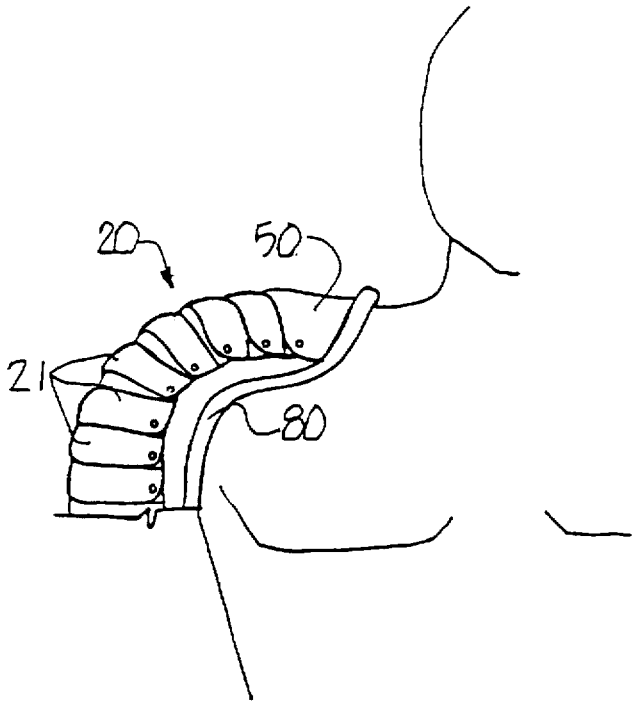
FIG. 9 is a side elevational view of the present invention adapted for use as a protective shoulder guard.
Figure 10:
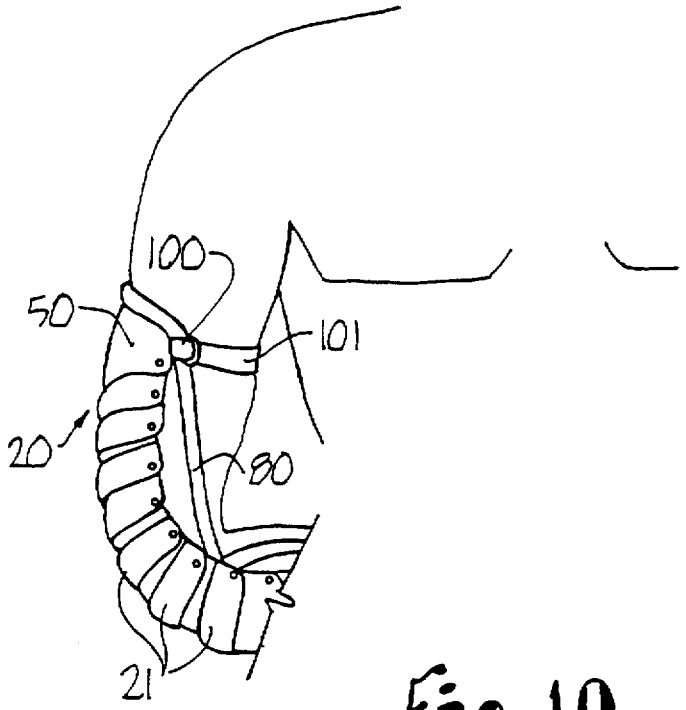
FIG. 10 is a side elevation view of the present invention adapted for use as a protective arm/elbow guard.

As seen from all of the accompanying drawings, the present invention relates to a protective joint guard 20 which provides continued maximum coverage to a joint and allows for extended coverage beyond the joint without inhibiting a player's mobility. As illustrated in FIG. 1 the protective joint guard 20 is adapted for use as a baseball catcher's leg guard 10. Although FIGS. 1–8 depict the protective joint guard 20 in the form of a leg guard 10, it is recognized that the use of the protective joint guard 20 is not limited to any particular sport, nor is its use limited to leg guards 10. As seen in FIGS. 9 and 10, the protective joint guard 20 can be adapted to cover and protect a player's elbow, shoulder or other jointed or flexible body part.

FIG. 1 shows a leg guard 10 comprising the protective joint guard 20, a shin guard 40, a thigh guard 50, an ankle guard 60 and a foot guard 70. As shown in FIGS. 1–4 and FIGS. 11 and 13, the protective joint guard 20 comprises a multiplicity of identical graduated interlocking rigid segments 21 that are formed to fit about the anterior of the knee, or other joint, and connected directly to one another by either pivot fasteners 31 (i.e. rivets, bolts, wire or other like fastener), or a stop pin 32 and pivot fastener 31 combination, illustrated in FIGS. 17 and 18.

Figure 11:
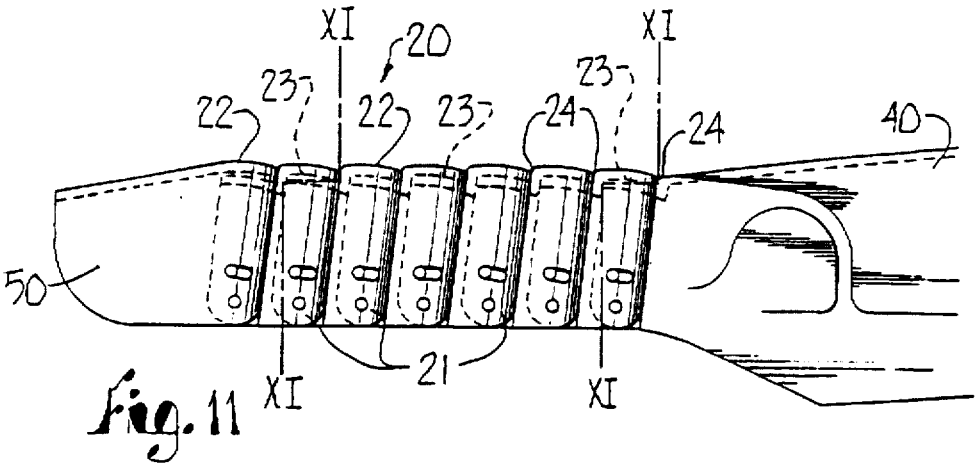
FIG. 11 is a side elevational view of the present invention.
Figure 12:
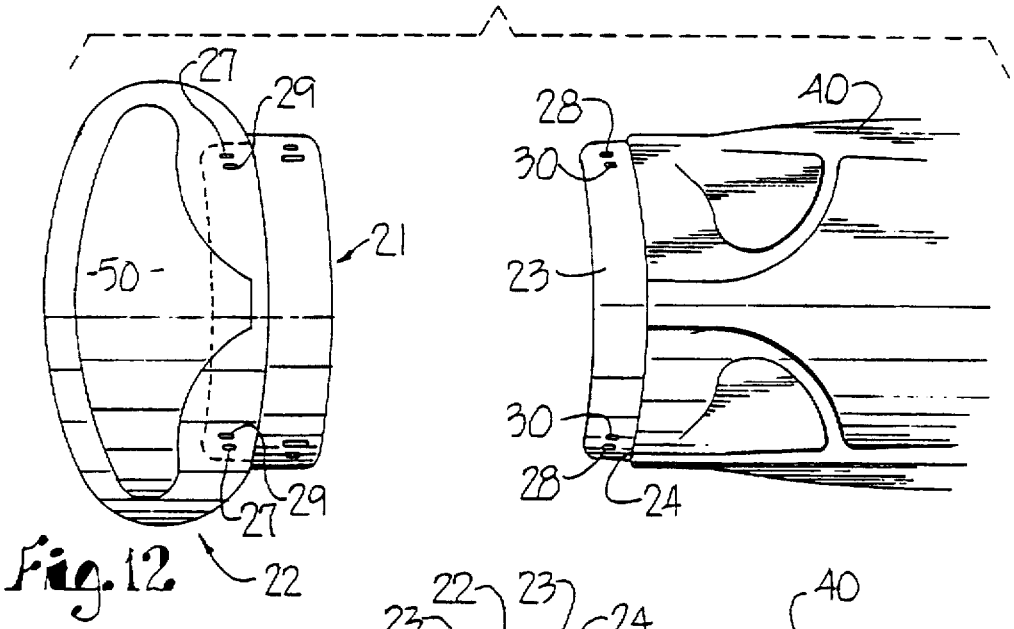
FIG. 12 is a sectional view of the present invention taken along lines XI—XI of FIG. 11.
Figure 13:
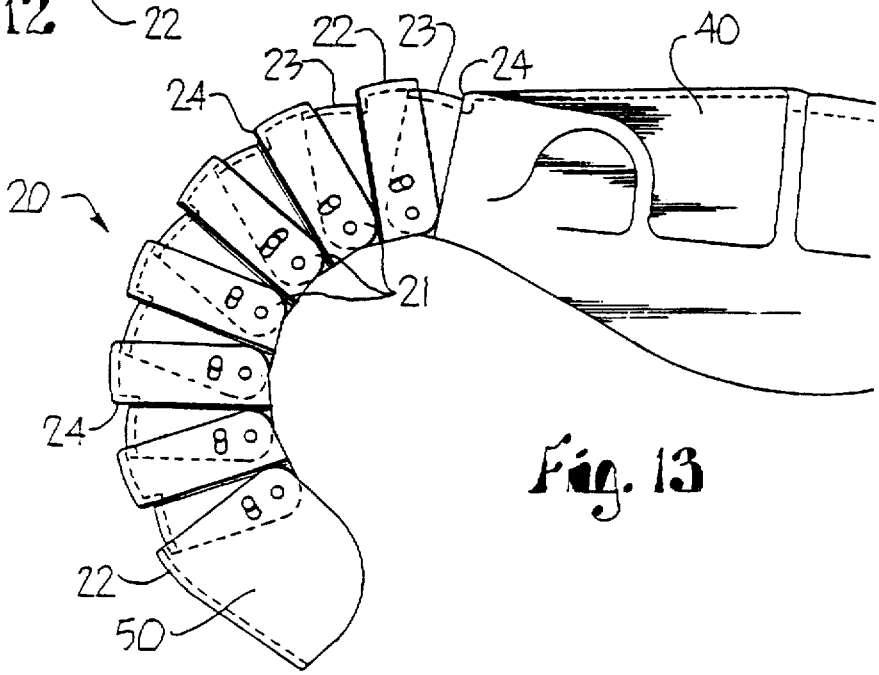
FIG. 13 is a side elevational view of the present invention shown in an extended position.
Figure 14:
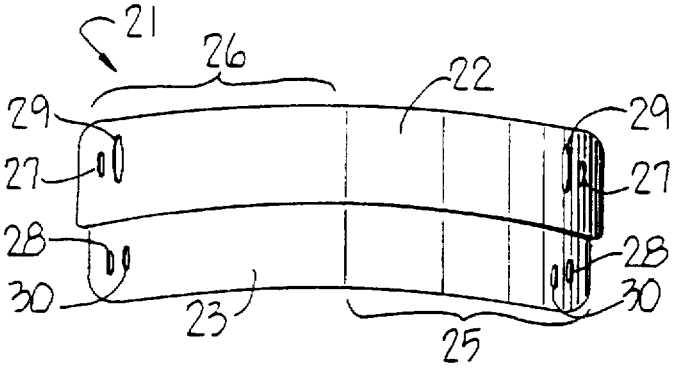
FIG. 14 is a plan view of a single interlocking segment comprising the present invention.
Figure 15:
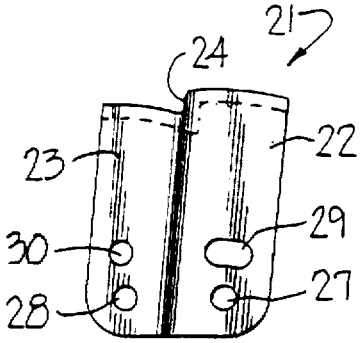
FIG. 15 is a side elevational view of the segment as shown in FIG. 14.
Figure 16:
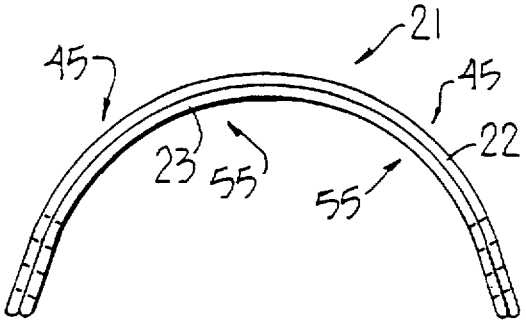
FIG. 16 is a front elevational view of the segment as shown in FIG. 14.

As shown in FIGS. 14–16, each interlocking rigid segment 21 has an upper piece 22 and a lower piece 23. The upper piece 22 and lower piece 23 are separated from one another by a slight abutment or lip 24. This lip 24 not only allows for the interconnection of the segments 21, but also acts to restrict the relative movement between the segments 21. As seen in FIGS. 11 and 12, the lower piece 23 of one segment 21 fits beneath the upper piece 22 of another segment 21. When the wearer's joint is straight, both the lower piece 23 and the upper piece 22 of the segment 21 abut the lip 24 of each adjoining segment 21. This interaction between segments 21 acts to restrict the movement of the protective joint guard 20 beyond 180 degrees, or the natural movement of the wearer's joint.

Figure 18:
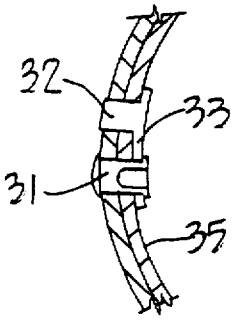
FIG. 18 is a fragmentary view demonstrating the interaction between the pin brackets and pivot fasteners as they are attached to the present invention.

Likewise, the manner in which the segments 21 are connected further restricts the relative movement between the segments so that there is no gap is created between the segments 21 when the knee is bent. As illustrated in FIGS. 14–16, each segment 21 has a right side 25 and left side 26, the left side 26 being a mirror image of the right side 25. The right side 25 of each segment has a first hole 27 and a second hole 28. As seen in FIG. 14, the first hole 27 is located on the upper piece 22 and the second hole 28 is located on the lower piece 23. The first hole 27 and the second hole 28 are positioned so that when two segments 21 are interlocked, the first hole 27 of one segment 21 aligns with the second hole 28 of the adjacent segment 21. A pivot fastener 31, as illustrated in FIG. 18, or other like connector, is then placed through the first hole 27 of one segment 21 and the second hole 28 of an adjacent segment 21 to directly connect the two interlocking segments 21.

Figure 17A:
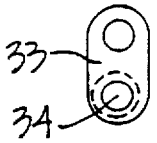
FIG. 17*a* is a front elevation view of a pin bracket.
Figure 17B:
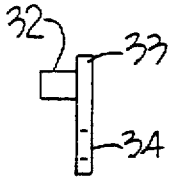
FIG. 17*b* is a side elevational view of the bracket as shown in FIG. 17.

While the segments 21 can be connected with the use of pivot fasteners 31 only, it is preferred that the segments 21 be connected to one another with a stop pin 32 and pivot fastener 31 combination. This connection is illustrated in FIGS. 14 through 18. As seen in FIG. 14, the right side 25 of each segment 21 has a slot 29 located directly above the first hole 27, and a third hole 30 located directly above the second hole 28. When interlocked, the slot 29 of one segment aligns with the third hole 30 of the adjacent segment. FIGS. 17, 18 illustrate a bracket 33 having an opening 34 for receiving a pivot fastener 31 and a stop pin 32. The bracket 33 is placed against the interior 55 of the adjoining segments 21 so that (1) the bracket opening 34 aligns with the first hole 27 and the second hole 28 of the respective adjoining segments 21; and (2) the bracket stop pin 32 fits through the third hole 30 and the slot 29 of the respective adjoining segments 21. The pivot fastener 31 is then placed through the bracket opening 34, the first hole 27 and the second hole 28 of the respective adjoining segment 21. The pivot fastener 31 then acts to pivotally connect the segments 21 directly to one another. The stop pin 32 and pivot fastener 31 connection restricts the relative movement between adjoining segments 21 so that the segments 21 do not gap when the knee is bent.

While not preferred, this stop pin 32 and pivot fastener 31 combination can also be accomplished by removing the third hole 30 entirely and replacing it with a stop pin similar in shape and size to the stop pin 32 used in connection with the bracket 33. The stop pin would extend from the lower piece 23 and be located in the same position as was the third hole 30. The stop pin would then extend through the slot 29 in the adjoining segment 21 just as the stop pin 32 did when connected to the bracket 33. Having the stop pin extending directly from the lower piece 23 eliminates the need for the bracket 33, but weakens the strength of the stop pin 32.

As seen in FIGS. 1–4, the interlocking activity between the segments 21 begins with a first portion 50 and ends with a last portion 40. The first portion 50 and last portion 40 can take many forms. As seen in FIG. 1, the first portion 50 is a thigh guard, also referred to as 50, and the last portion 40 is a shin guard, also referred to as 40. Regardless of form, the first portion 50 begins the interconnection of the segments 21 and the last portion 40 ends such chain of interconnecting segments 21. As seen in FIGS. 11 and 12, the first portion 50 has at least the equivalent qualities of an upper portion 22, having holes 27 and slot 29, which allow the first portion 50 to pivotally connect to the lower portion 23 of the first adjacent segment 21. Similarly, the last portion 40 has at least the equivalent qualities of a lower portion 23, having holes 28 and 30 and a lip 24, which enable the last portion 40 to adjoin to the segment 21 just adjacent to the last portion 40.

Figure 5:
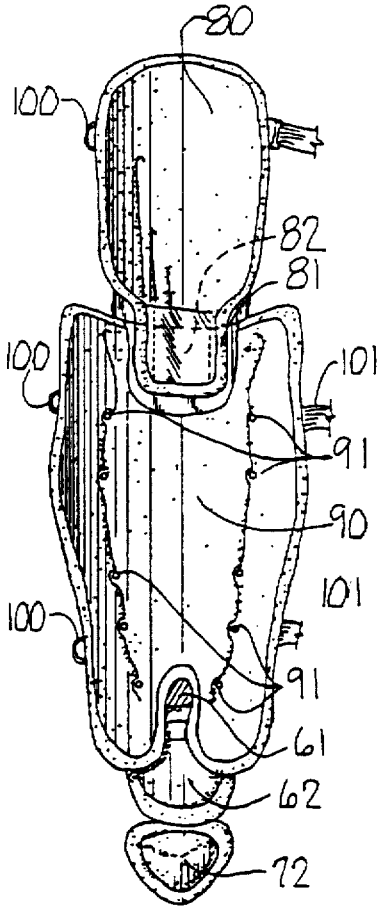
FIG. 5 is a rear elevational view of the protective leg guard, as shown in FIG. 1.
Figure 6:
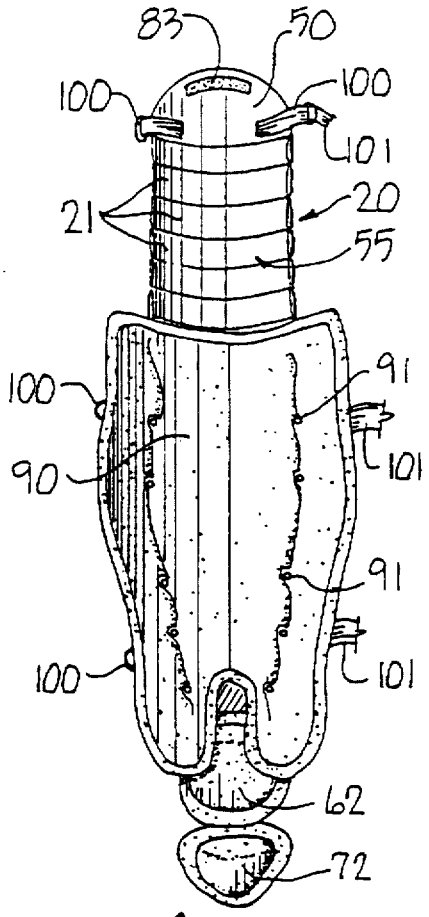
FIG. 6 is a rear elevational view of the protective leg guard, as shown in FIG. 5, with the padding housed behind the knee portion detached.
Figure 7:
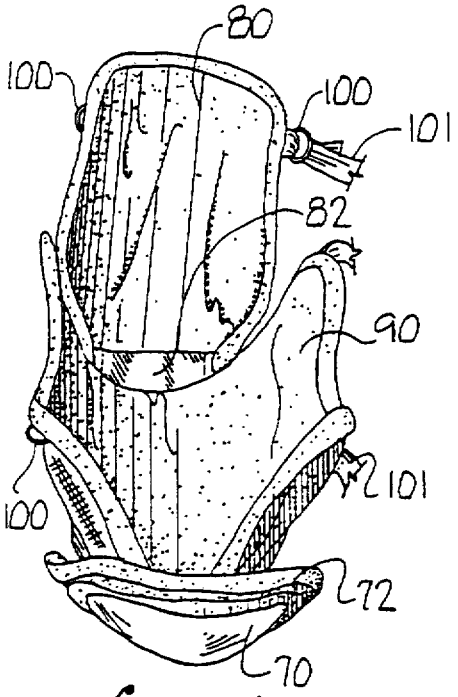
FIG. 7 is a bottom view of the leg guard as shown in FIG 5.
Figure 8:
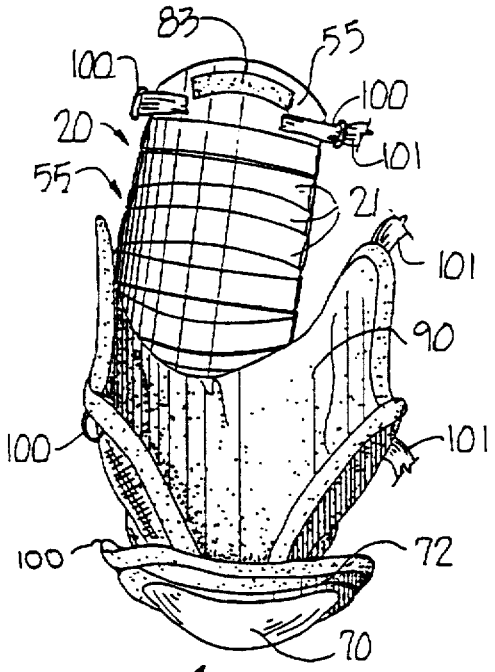
FIG. 8 is a bottom view of the leg guard as shown in FIG. 6.

As seen in FIG. 1, the thigh guard 50 (or first portion), the protective joint guard 20, and the shin guard 40 (or last portion) are preferably constructed from relatively rigid plastic material, such as high density polyethylene or like material. Therefore, the thigh guard 50, the protective joint guard 20 and the shin guard 40 all have a hard exterior shell 45 and a hard interior shell 55. To protect a wearer's leg from contact with the hard interior shell 55 of guards 20, 40, and 50, a first pad 80 is affixed to the interior shell 55 of the thigh guard 50 and a second pad 90 is affixed to the interior shell 55 of the shin guard 40. As seen in FIGS. 5 and 6, the first pad 80 is detachable and is affixed to the interior shell 55 of thigh guard 50 with a hook and loop fastener 83. While attachment with a hook and loop fastener 83 is preferred, other similar means for attaching the first pad 80 may be used (e.g. snaps, rivets). The first pad 80 extends from the interior shell 55 of the thigh guard 50 across the entire length of the protective guard 20, but is not affixed in anyway to the protective guard 20 or the shin guard 40. Being attached only to the thigh guard 40 allows the protective guard 20 to move without be restricted by the first pad 80. This also allows the first pad 80 to move independent from the protective guard 20 when responding to the increasing and decreasing lineal length of the protective guard 20 as the underlying joint moves from a bent position to a straight position or vise-versa.

While the first pad is not restricted from moving upward and downward in responses to the movement of the wearer's joint, the first pad 80 is however some what restricted from moving side-to-side by the relationship between the first pad 80 and the second pad. As seen in FIGS. 5 and 6, the second pad 90 is affixed to the interior shell 55 of the shin guard 40 by at least two, if not more, pairs of pins 91 which run parallel to one another the lineal length of the second pad 90. These pairs of pins 91 are spaced just far enough apart to allow a narrow extension 81 of the first pad 80 to rest between the second pad 90 and the shin guard 40. The narrow extension 81 is allowed to move between the second pad 90 and the shin guard 40 in an upward and downward direction, in response to the change in length of the protective guard 20, without completely removing itself from between the second pad 90 and the shin guard 40. Although not necessary, the narrow extension 81 of the first pad 80 has a plastic covering 82 which faces the second pad 90. This covering 82 helps to decrease the amount of friction between the narrow extension 81 and the second pad 90 and allow the first pad 80 to slide more freely between the second pad 90 and the shin guard 40.

Although the above retractable first pad 80 is preferred, the first pad 80 can also be made of material that is sufficiently flexible to allow the free movement of the protective joint guard 20, shin guard 40 and thigh guard 50 while affixed to not only the thigh guard 50, but also the interior shell of either the shin guard 40 or the protective joint guard 20, or both.

FIGS. 1–8 illustrate that in addition to the first and last portions, 50 and 40 respectively, subsequent pieces may be also be added to the first portion 50, last portion 40, or both, to provide extend protection across the same or additional body parts. FIGS. 1–8 show a protective ankle guard 60 connected to the shin guard 40 by a flexible padded strip 61 that is positioned intermediate the shin guard 40 and the ankle guard 60. The intermediate strip 61 is connect to both the shin guard 40 and the ankle guard 60 by pins, rivets or like connectors.

Also illustrated in FIGS. 1–8 is a protective foot guard 70 connected to the ankle guard 60 using an intermediate strip 71 similar to that attaching the ankle guard 60 to the shin guard 40. Like the shin guard 40, both the ankle guard 60 and the foot guard 70 have cushions or pads, 62 and 72 respectively, connected to the interior shell 55. These cushions 62 and 72 are attached to the ankle guard 60 and foot guard 70 by pins, rivets, snaps or like attaching devises.

FIGS. 1–8 also show the strap means used to connect the leg guard 10 to a wear's leg. As seen in FIGS. 1–4, a plurality of metallic loops 100 extend from the outer edges 41 of the shin guard 40. These loops 100 are connected to the shin guard 40 by placing the loops 100 between the second pad 90 and the shin guard 40 and riveting the loops 100 directly to the shin guard 40. These connecting rivets may be the same rivets 91 that connect the second pad 90 to the shin guard 40 or different, entirely independent connectors. While it is preferred that the loops 100 be made of a metallic material, the loops 100 can also be made of a durable plastic. These loops extend from all edges 44 of the shin guard 40, so that each loop 100 has a corresponding loop 100 located on the opposite edge 41 of the shin guard 40. One of the corresponding loops 100 has an adjustable nylon/elastic straps 101 extending therefrom which has a male coupler 102 for attaching to the opposing corresponding loop 100. The strap 101 extend around the wearer's leg and so that the male couple 102 attached to the corresponding loop 100. This allows the leg guard 10 to securely and adjustably connect to the wearer's leg. Other guards, such as the thigh guard 50, use this same strap mechanism to secure the guard 50 against the wearer's thigh. Likewise, as shown in FIGS. 9 and 10, this same strap mechanism can be used to attach the protective joint guard 20 to other parts of a wearer's body.

It is to be understood that while certain forms of this invention have been illustrated and described, the invention is not limited to the specific forms or arrangement of parts described thereto, except insofar as such limitations are included in the following claims.

What is claimed and desired to be secured by Letters Patent is as follows:

1. A protective joint guard for protecting a joint against contact, said joint guard comprising:

a plurality of uniformly shaped rigid segments wherein each of said segments is shaped to extend transversely across the anterior surface of a portion of a joint and wherein the segments are interlocked with adjacent segments to extend continuously without interruption along a length of the joint, said segments being locked together in a manner to enable the segments to move relative to one another so as to conform in shape to the joint throughout an entire range of motion of the joint and to extend continuously without interruption along a length of the joint through said entire range of motion.

2. A protective joint guard as recited in claim 1, wherein each said segment has a lower piece and an upper piece, said lower piece being separated from said upper piece by a lip to allow the lower piece of each said segment to fit beneath the upper piece of an adjacent segment.

3. A protective joint guard as recited in claim 2, wherein each said segment extends from a first side of the segment transversely across the joint to a second side of the segment, said first side having an upper hole provided through the upper piece of said segment and a lower hole provided through the lower piece of said segment such that, when the segments are interlocked, the upper hole of each segment aligns with the lower hole of an adjacent segment, said segments being interlocked by placing the upper piece of one said segment over the lower piece of an adjacent segment.

4. A protective joint guard as recited in claim 3, wherein said guard additionally comprises a plurality of pivot fasteners, wherein each said pivot fastener pivotally connects adjacent segments to one another by passing the pivot fastener through the upper hole of one segment and the lower hole of an adjacent segment.

5. A protective joint guard as recited in claim 4, wherein the second side of each segment includes a second upper hole provided through the upper piece of the segment and a second lower hole provided through the lower piece of the segment, such that, when the segments are interlocked, the second upper hole of each segment aligns with the second lower hole of an adjacent segment, said segments being interlocked by placing the upper piece of one said segment over the lower piece of an adjacent segment and connecting adjacent segments to one another by passing one of said pivot fasteners through the upper hole of one segment and the lower hole of an adjacent segment.

6. A protective joint guard as recited in claim 5, wherein said protective guard further comprises a means for restricting the range of motion of said segments relative to one another.

7. A protective joint guard as recited in claim 6, wherein said restricting means comprises at least one stop pin extending from the lower piece of each segment and at least one elongated slot provided through the upper piece of each segment, said stop pin aligns with and extends through an elongated slot of an adjacent segment to restrict the range of motion between any two adjacent segments.

8. A protective joint guard as recited in claim 7, wherein each said segment has at least one pin-receiving hole located on the lower piece of the segment, wherein said stop pin restricts the motion between two said adjacent segments by extending through the pin-receiving hole of one segment and the elongated slot of an adjacent segment.

9. A protective joint guard as recited in claim 8, wherein a stop pin, elongated slot, and pin-receiving hole are each provided on the first side and the second side of each segment to restrict the range of motion of the segments.

10. A protective joint guard as recited in claim 9, additionally comprising a means for connecting the joint guard to a wearer.

11. A protective joint guard for protecting a joint against contact, said joint guard comprising:

(a) a plurality of uniformly shaped rigid segments wherein each of said segments is configured to extend from a first side to a second side of the segment transversely across an anterior surface of a portion of a joint, wherein the segments are interlocked with adjacent segments to extend continuously without interruption along a length of the joint, wherein each said segment has a lower piece and an upper piece, said lower piece being separated from said upper piece by a lip to allow the lower piece of the segment to fit beneath the upper piece of an adjacent segment, and wherein an upper hole and a lower hole are provided through said first side of each segment and a second upper hole and a second lower hole are provided through said second side of each segment, said upper holes being located on the upper piece of the segment and said lower holes being located on the lower piece of the segment such that, when the segments are interlocked, the upper holes of each segment align with the lower holes of an adjacent segment, said segments being interlocked by placing the upper piece of one segment over the lower piece of an adjacent segment;

(b) a plurality of pivot fasteners, wherein said pivot fasteners pivotally connect adjacent segments to one another by passing through the upper holes of one segment and the lower holes of an adjacent segment enabling the segments to move relative to one another so as to conform in shape to the joint throughout an entire range of motion of the joint, and wherein the first side of each said segment has an elongated slot through the upper piece of the segment, and the second side of each said segment has a second elongated slot through the upper piece of the segment;

(c) a plurality of stop pins, the first side of each said segment having a stop pin extending from the lower piece of the segment, and the second side of each said segment having a second stop pin extending from the lower piece of the segment, said stop pins aligning with and extending through the slots of an adjacent segment to restrict the range of motion between any two adjacent segments; and (d) a plurality of straps for connecting the joint guard to a wearer.

12. A protective leg guard for protecting a leg against contact, comprising:

(a) a protective knee guard comprising a plurality of uniformly shaped rigid segments, said plurality of segments extending continuously from a first segment to a last segment to cover a length of a knee joint, wherein the segments are interlocked to move relative to one another so as to conform in shape to the knee joint without interruption throughout an entire range of motion of the knee joint (b) a thigh guard pivotally connected to said first segment, said thigh guard having a hard shell;

(c) a shin guard pivotally connected to said last segment, said shin guard having a hard shell.

13. A protective leg guard as recited in claim 12 further comprising a retractable pad connected to an interior surface of said thigh guard.

14. A protective leg guard as recited in claim 12 further comprising a shin pad connected to an interior surface of said shin guard.

15. A protective leg guard as recited in claim 14 further comprising a retractable pad connected to an interior surface of said thigh guard, wherein said retractable pad drops down between the interior surface of said shin guard and said shin pad, said retractable pad sliding upward and downward between said shin guard and said shin pad in response to movement of a wearer's joint without completely removing itself from between the confines of said shin pad and said shin guard.

16. A protective leg guard as recited in claim 12, further comprising an ankle guard extending from said shin guard to protect an ankle of a wearer from contact.

17. A protective leg guard as recited in claim 16, further comprising a foot guard extending from said ankle guard to protect a foot of a wearer from contact.

18. A protective leg guard as recited in claim 17, further comprising a means for connecting the joint guard to a wearer.

* * * * *

UNITED STATES PATENT AND TRADEMARK OFFICE
CERTIFICATE OF CORRECTION

PATENT NO : 5,794,261
DATED : August 18, 1998
INVENTOR(S) : Dennis V. Hefling

It is certified that error appears in the above-identified patent and that said Letters Patent is hereby corrected as shown below:

Column 2, line 1, "provided":

should be deleted and --provide-- should be inserted therefor.

Column 3, line 48 after

"no gap" delete --is--.

Column 4, line 30, after "bracket 33" delete "." and insert therefore --,--.

Column 5, line 1 "be"

should be deleted and --being-- should be inserted therefor.

Column 5, line 9 "some what" should be deleted and --somewhat-- should be inserted therefor.

Column 5, line 43

"connect" should be deleted and --connected-- should be inserted therefor.

Column 5, line 66 "44' should be deleted and --41-- should be inserted therefor.

UNITED STATES PATENT AND TRADEMARK OFFICE

CERTIFICATE OF CORRECTION

PATENT NO. : 5,794,261
DATED : August 18, 1998
INVENTOR(S) : Dennis V. Hefling

It is certified that error appears in the above-identified patent and that said Letters Patent is hereby corrected as shown below:

In Claim 12, column 8, line 25 after "knee joint" insert --;--.

Signed and Sealed this

Twenty-ninth Day of December, 1998

*Attest:*

Bruce Lehman

BRUCE LEHMAN

*Attesting Officer*

*Commissioner of Patents and Trademarks*